US009277794B2

(12) United States Patent
Moreau

(10) Patent No.: US 9,277,794 B2
(45) Date of Patent: Mar. 8, 2016

(54) VERSATILE WALKING CANE

(71) Applicant: Regis C Moreau, Ft. Lauderdale, FL (US)

(72) Inventor: Regis C Moreau, Ft. Lauderdale, FL (US)

( * ) Notice: Subject to any disclaimer, the term of this patent is extended or adjusted under 35 U.S.C. 154(b) by 0 days.

(21) Appl. No.: 14/599,446

(22) Filed: Jan. 16, 2015

(65) Prior Publication Data

US 2015/0196102 A1 Jul. 16, 2015

Related U.S. Application Data

(60) Provisional application No. 61/928,397, filed on Jan. 16, 2014.

(51) Int. Cl.

| | |
|---|---|
| ***A45B 3/00*** | (2006.01) |
| *A45B 9/00* | (2006.01) |
| *A61H 3/02* | (2006.01) |
| *A45B 9/04* | (2006.01) |

(52) U.S. Cl.

CPC ... *A45B 3/00* (2013.01); *A45B 9/04* (2013.01); *A45B 2009/007* (2013.01); *A61H 2003/0222* (2013.01)

(58) Field of Classification Search

CPC ..... A45B 9/04; A45B 2009/007; A45B 3/00; A61H 2003/0222; A47G 25/82

USPC ..... 135/66, 75, 77, 78; 294/104

See application file for complete search history.

(56) References Cited

U.S. PATENT DOCUMENTS

| | | | | | |
|---|---|---|---|---|---|
| 2,346,038 | A | * | 4/1944 | Mason | 294/104 |
| 2,478,325 | A | * | 8/1949 | Russell | 362/102 |
| 2,642,519 | A | * | 6/1953 | Caustin et al. | 362/577 |
| 2,836,188 | A | * | 5/1958 | Jordan | 135/66 |
| 3,105,715 | A | * | 10/1963 | Happ | 294/61 |
| 3,146,015 | A | * | 8/1964 | Roberge | 294/104 |
| 3,336,469 | A | * | 8/1967 | Barnes, Sr. et al. | 362/102 |
| 3,425,734 | A | * | 2/1969 | Hollis | 294/104 |
| 3,763,872 | A | * | 10/1973 | Gooley | 135/66 |
| 4,062,371 | A | * | 12/1977 | Bolen | 135/66 |
| 4,200,322 | A | * | 4/1980 | Smith | 294/104 |
| 4,562,850 | A | * | 1/1986 | Earley et al. | 135/66 |
| 4,709,839 | A | * | 12/1987 | Tucker | 223/119 |
| 4,966,316 | A | * | 10/1990 | George et al. | 223/119 |
| 5,176,160 | A | * | 1/1993 | Osborn | 135/66 |
| 5,197,501 | A | * | 3/1993 | Ragatz | 135/66 |
| 5,351,704 | A | * | 10/1994 | Hunnicutt et al. | 135/66 |
| 5,392,800 | A | * | 2/1995 | Sergi | 135/65 |
| 5,433,234 | A | * | 7/1995 | Lapere | 135/66 |
| 5,588,735 | A | * | 12/1996 | Harada | 362/102 |
| 5,636,650 | A | * | 6/1997 | Kroeze | 135/66 |
| 5,640,985 | A | * | 6/1997 | Snyder et al. | 135/65 |
| 5,722,445 | A | * | 3/1998 | Hae et al. | 135/65 |
| 5,901,723 | A | * | 5/1999 | Ames | 135/66 |
| 5,961,012 | A | * | 10/1999 | Bucher | 223/119 |

(Continued)

FOREIGN PATENT DOCUMENTS

| | | | | | |
|---|---|---|---|---|---|
| GB | 2122077 | A | * | 1/1984 | A45B 3/00 |

*Primary Examiner* — Robert Canfield

(74) *Attorney, Agent, or Firm* — Smith Risley Tempel Santos LLC; Gregory Scott Smith

(57) ABSTRACT

A versatile walking cane that has an adjustable length and a jaw-grip. The walking cane includes a trigger that can be actuated to mechanically operate the jaw-grip from an open to a closed position. In the closed position, the jaw-grip is retracted into the interior of the cane and does not obstruct the use of the cane for walking. The cane includes an interface for receiving additional tools and an illumination source.

18 Claims, 8 Drawing Sheets

(56) References Cited

U.S. PATENT DOCUMENTS

| | | | | |
|---|---|---|---|---|
| 6,328,048 | B1 * | 12/2001 | Rivera, Sr. | 135/66 |
| 6,394,116 | B1 * | 5/2002 | Winn et al. | 135/65 |
| 6,550,490 | B1 * | 4/2003 | Morton et al. | 135/66 |
| 6,951,224 | B2 * | 10/2005 | Garrett | 135/66 |
| 7,243,668 | B1 * | 7/2007 | Kroeze | 135/77 |
| 7,624,746 | B2 * | 12/2009 | Blake | 135/65 |
| 7,784,479 | B2 * | 8/2010 | Navarro | 135/66 |
| D632,069 | S * | 2/2011 | Thiessens | D3/7 |
| 8,122,900 | B1 * | 2/2012 | Hayes et al. | 135/66 |
| 8,381,748 | B2 * | 2/2013 | Martin | 135/66 |
| 8,978,677 | B2 * | 3/2015 | Roberts | 135/66 |
| 2002/0117196 | A1 * | 8/2002 | Han | 135/114 |
| 2004/0255995 | A1 * | 12/2004 | Garrett | 135/66 |
| 2004/0264172 | A1 * | 12/2004 | Roberts | 362/102 |
| 2006/0090783 | A1 * | 5/2006 | King-Fai | 135/67 |
| 2006/0266397 | A1 * | 11/2006 | Berl | 135/70 |
| 2008/0128009 | A1 * | 6/2008 | Blake | 135/75 |
| 2008/0149155 | A1 * | 6/2008 | Martin | 135/66 |
| 2009/0032077 | A1 * | 2/2009 | Hines | 135/66 |
| 2011/0155195 | A1 * | 6/2011 | Martin | 135/66 |
| 2012/0060878 | A1 * | 3/2012 | Thiessens | 135/66 |
| 2014/0240963 | A1 * | 8/2014 | Roberts | 362/102 |
| 2014/0261590 | A1 * | 9/2014 | Riemer | 135/66 |

* cited by examiner

PARTS LIST

1. ALUMINUM HAND GRIP
2. 3/16' DIA. PUSH PIN HOLES
3. ALUMINUM TRIGGER WITH 3' L. EXTENSION
4. 1' DIA. 18 GA. ANOD. ALUM. SHAFT
5. 7/8' DIA. 18 GA. ANOD. ALUM. SHAFT W/ 1' TAPERED TIP
6. 3/8' X 8' L. RUBBER BAND
7. POSITIVE PIN W/ A TORSION SPRING W/ 1/4' BODY & 1' LEGS.
8. RECESSED ADJUSTABLE ALUMINUM GRABBER WITH TEETH - 8' L.
9. HOOK & ADJUSTABLE CHORD
10. ALUMINUM SNAP-ON SHOEHORN W/ SLEEVE ATTACHMENT
11. 1/2' TH. X 7/8' DIA. NOTCHED SOFT RUBBER TIP
12. 1/2' X 1/2' ALUMINUM U-SHAPED GUIDE TRACK
13. NYLON STRING TO TRIGGER
14. SPRING-LOADED 1/4' DIAMOND HEAD LOCATING PIN

FIG. 8D

VERSATILE WALKING CANE

CROSS-REFERENCE TO RELATED APPLICATIONS

This is a utility patent application being filed in the United States as a non-provisional application for patent under Title 35 U.S.C. §100 et seq. and 37 C.F.R. §1.53(b) and, claiming the benefit of the prior filing date under Title 35, U.S.C. §119(e) of the United States provisional application for patent that was filed on Jan. 16, 2014 and assigned Ser. No. 61/928,397, which application is incorporated herein by reference in its entirety.

BACKGROUND

A walking stick or cane is a device used by many people to facilitate balancing while walking. Walking canes come in many shapes and sizes, and can be sought by collectors. Some styles of walking canes include features and aspects more suitable for use by people with disabilities. For instance, a walking cane can be constructed such that it can be used as a crutch or a tool. In addition, the walking cane has historically been known to be used as a defensive or offensive weapon, and may conceal a knife or sword or simply can be used to ward off over excited dogs.

Walking canes, also known as trekking poles, pilgrim's staffs, hiking poles or hiking sticks, are used by hikers for a wide variety of purposes, such as clearing spider webs, parting thick bushes or grass obscuring the trail; providing support when going uphill or providing braking help when going downhill; serving as a balance point when crossing streams, swamps or other rough terrain; as feeler for finding obstacles in the path; for testing mud and puddles for depth; and for providing a defense against wild animals. A walking cane can be improvised from nearby felled wood. More ornate sticks are made for avid hikers, and are often adorned with small trinkets or medallions depicting "conquered" territory. Wood walking canes are used for outdoor sports, healthy upper body exercise and even club, department and family memorials. They can be individually handcrafted from a number of woods, and may be personalized in many ways for the owner.

For those that find the need for, or simply just fancy the use of a walking cane, it can be very convenient for the walking cane to provide a variety of additional functions. Thus, there is a need in the art for a versatile walking cane that can be used for a variety of other purposes.

SUMMARY

The present disclosure presents various embodiments, as well as aspects and features of a versatile walking cane. In one embodiment, the walking cane includes an upper shaft and a lower shaft. The upper shaft and lower shaft are configured such that they can be slid together, such as a telescope, to create a cane shaft. The length of the walking cane can be adjusted by sliding the upper shaft and lower shaft to different positions. Once the cane shaft is of the desired length, the upper shaft and lower shaft can be locked into position. The various embodiments also include a handle attached to one end of the cane shaft. The handle includes a trigger that can be actuated by applying a force to pull the trigger towards the handle such as a squeezing force.

The various embodiments may include a jaw-grip that pivotally attaches proximate to an the end of the cane shaft distal from the handle. The jaw-grip is pivotally coupled to the lower shaft and to the trigger in such a manner that when the trigger is actuated, the jaw-grip moves to a first position and when the trigger is released, the jaw-grip moves to a second position. In one embodiment, the jaw-grip is biased into a closed position by a torsion spring. In another embodiment, the jaw-grip is biased into an open position by a torsion spring. In yet another embodiment, the jaw-grip can be biased into an open position or a closed position by mechanically switching between one of two torsion springs.

The walking cane includes a tip positioned on the opposing end of the cane shaft from the handle. The tip can be placed on a surface when the walking cane is used for supporting a walking user and, the jaw-grip does not obstruct the tip from engaging such surface.

These and other embodiments, features and aspects of the various embodiments are presented in more detail in the drawings and the accompanying description.

BRIEF DESCRIPTION OF THE DRAWINGS

FIGS. 8A-8D show an alternative embodiment of a walking cane, FIG. 8A presents a top or front view, FIG. 8B illustrates a side view and FIG. 8C illustrates a bottom or back view. FIG. 8D provides a parts list for the illustrated embodiment.

DETAILED DESCRIPTION OF THE VARIOUS EMBODIMENTS

The present disclosure presents various embodiments, as well as features, aspects and functionality that can be incorporated into one or more embodiments of the versatile walking cane. In general, the various embodiments of the walking cane include the ability to adjust the length of the walking cane, and to adjust the functionality of the walking case. The walking can an utilize the walking cane for additional activity such as, a gripper for picking up items, a show horn for putting on shoes, a blade for cutting or digging, a light to assist in navigation, etc.

Figures 1, 2:
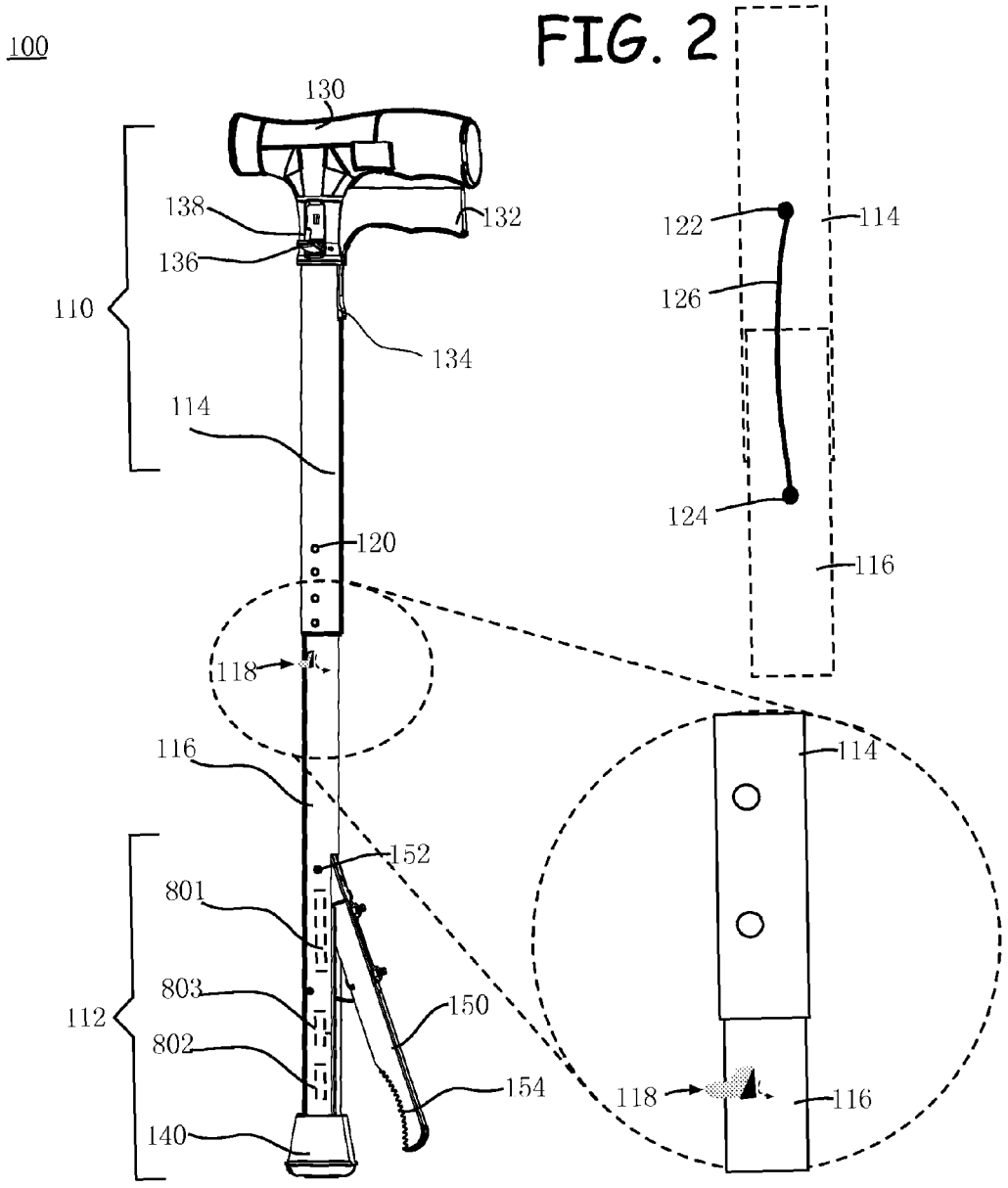
FIG. 1 is a conceptual diagram illustrating the top, side and bottom view of one embodiment of the versatile walking cane.
FIG. 2 is a diagram illustrating an exemplary hinging feature that can be incorporated into various embodiments of the walking cane.

FIG. 1 is a conceptual diagram illustrating the top, side and bottom view of one embodiment of the versatile walking cane. The illustrated embodiment of the walking cane 100 includes a handle end 110 and a tool end 112. In the illustrated embodiment, the handle end 110 and the tool end 112 are joined together by two adjustable, telescoping poles including an upper shaft 114 and a lower shaft 116. It should be appreciated that the shafts may be a single, non-adjustable shaft in some embodiments and may include more than two pieces in other embodiments.

The upper shaft 114 and lower shaft 116 can be constructed of a variety of materials, including aluminum, anodized aluminum, metal, stainless steel, plastic, composite materials, fiberglass, as a few non-limiting examples. The upper shaft 114 and lower shaft 116 may screw together, be secured by adhesive or rubber grommet, or as illustrated, by using a spring loaded push-pin 118. In another embodiment, the upper shaft and lower shaft can be adjusted and secured together by a rotating locking mechanism similar to what is used in shower rods, wherein rotating the shafts in one set of opposing directions allows the shafts to freely slide relative to each other and, rotating the shafts in another set of opposing directions locks the shafts together in a particular position. In the illustrated embodiment, the multiple shaft design advantageously allows the walking cane to be adjusted in length and, enables it to be broken down for ease of storage.

In the spring loaded push-pin embodiment, the lower shaft 116 may include a spring-loaded push-pin 118 protruding from one or more sides of the shaft and the upper shaft 114 may include one or more orifices or apertures 120 that are configured to receive the push-pin 118. Further, the upper shaft 114 is constructed to have an interior diameter that is slightly larger than the exterior diameter of the lower shaft 116 to allow the upper shaft 114 to slide down and over the lower shaft 116. In the illustrated embodiment, the upper shaft 114 can thus be slid down and over the lower shaft 116 while depressing the spring-loaded push-pen 118. Upon aligning the push-pin 118 with the aperture 120, or one of the apertures, the push-pen 118 penetrates through the aperture 120 to secure the upper shaft 114 and the lower shaft 116 into a particular position. Thus, by having multiple apertures 120, the length of the walking cane 100 can be adjusted. Further, a user may depress the push-pin 118 and pull the lower shaft 116 and the upper shaft 114 in opposing directions to separate the two shafts.

FIG. 2 is a diagram illustrating an exemplary hinging feature that can be incorporated into various embodiments of the walking cane. In the illustrated embodiment, a securement 122 and a securement 124 are used to secure a hinging element 126 that extends between the interior surface of the upper shaft 114 and the lower shaft 116. The hinging element 126 may be used in addition to or in lieu of the push-pin 118 to retain the upper shaft 114 and the lower shaft 116 together but, to allow them pulled apart and folded over each other for storage. For instance, the hinging element 126 may be a rubber band, a silicone cord, a spring, an elastic band as a few non-limiting examples. The hinging element 126 may be attached at one end to an interior surface of the lower shaft 5 and at the opposing end to an interior surface of the upper shaft 114. Alternatively, the hinging element 126 may be attached to the outer surfaces of the lower shaft 116 and upper shaft 114. In other embodiments, the hinging element 126 may run the entire length of the lower shaft 116 and upper shaft 114 and be attached to a tip end of the lower shaft 116 and a handle end of the upper shaft 114.

Figure 3:
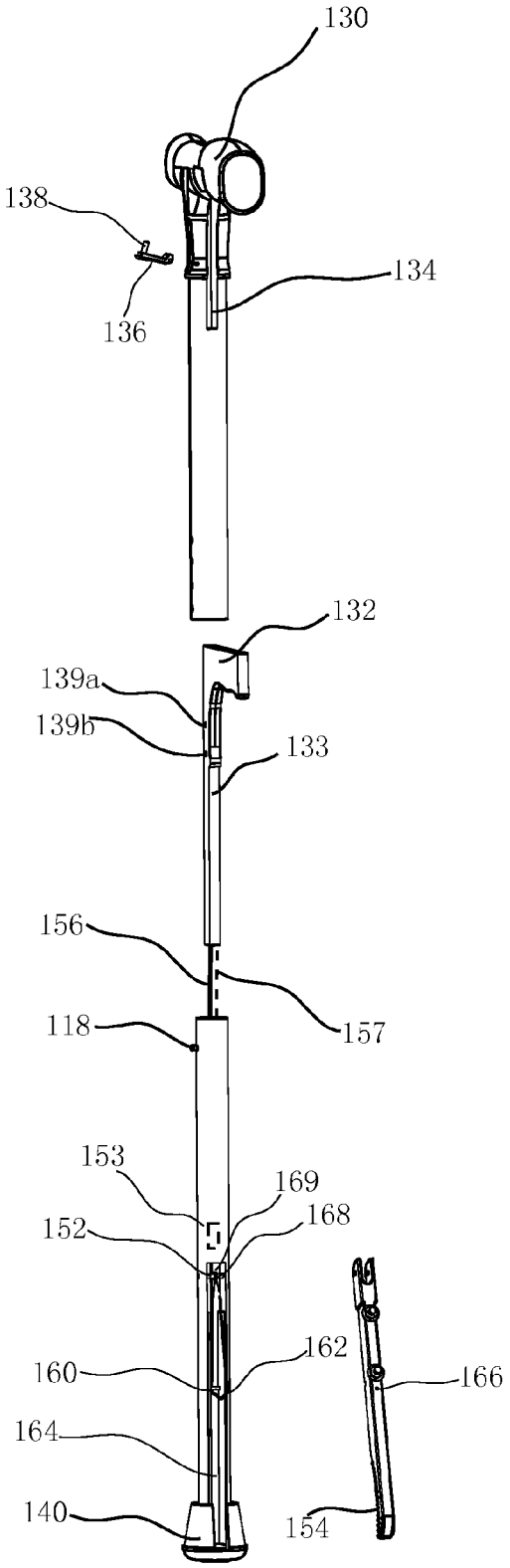
FIG. 3 is an exploded view of the walking cane 100 illustrated in FIG. 1 and presents further detail of the operation of the steady-state open embodiment of the jaw-grip 150.

The handle end 110 of the walking cane 100 includes a hand-grip 130 and a trigger 132. The hand-grip 130 and trigger 132 can be constructed of a variety of material including rubber, plastic, wood, aluminum, anodized aluminum, metal, stainless steel, plastic, composite materials, fiberglass, as a few non-limiting examples. The trigger 132 is configured such that it can be squeezed and thus, retracted into the handle 130. When the trigger 132 is squeezed, it operates to actuate an element at the tool end 112 of the walking cane 100. A guide 134 is used to allow the trigger 132 to move into its retracted position into the handle 130 and then back to a steady state position outside of the handle 130. The illustrated embodiment also includes a lock 136 that can be moved into a closed position to lock the trigger 132 into either the retracted position or the steady state position. In the illustrated embodiment, the lock 136 includes a pin 138 that penetrates an aperture defined within the trigger 132, such as aperture 139*a* or 139*b* as shown in FIG. 3. In the illustrated embodiment, one aperture 139*b* aligns with the pin 138 for the retracted position and one aperture 139*a* aligns with the pin 138 for the steady state position.

The tool end 112 of the walking cane 100 is illustrated as including a tip 140. The tip 140 is general constructed such that it fits over the end of the lower shaft or is inserted into a hole of the lower shaft. The tip 140 may be constructed of a material that can provide stability for the cane and prevent it from sliding on smooth surfaces. For instance, rubber or silicone could be used as a non-limiting example. The illustrated tip 140 slides over the end of the lower shaft 116 to introduce friction to a surface, thus helping to prevent the walking cane 100 from sliding during use.

The tool end 112 of the walking cane 100 may include one or more of a variety of tools that can be utilized by the user of the walking cane 100.

In the illustrated embodiment, a jaw-grip tool 150 is pivotally attached to the lower shaft 116 utilizing a pin 152.

At least a portion of the interior surface of the jaw-grip 150 includes a contoured series of teeth 154 to facilitate griping of an object. The jaw-grip tool 150 is mechanically associated with the trigger 132 such that when the trigger is moved to the retracted position, the jaw-grip 150 is closed, and when the trigger is released to move towards the steady state position, the jaw-grip 150 is opened. It should be appreciated that in some embodiments this mechanism may be reversed. For instance, the first embodiment, a user can release the trigger 132 to open the jaw-grip 150, slide the gap created between the lower shaft 116 and the jaw-grip 150 over an object to be moved, and then squeeze the trigger 132 to clamp the jaw-grip 150 around the object. In the second embodiment, the reversed operation embodiment, the user may squeeze the trigger 132 to open the gap between the lower shaft 116 and the jaw-grip 150, slide the gap created between the lower shaft 116 and the jaw-grip 150 over an object to be moved, and then release the trigger 132 to clamp the jaw-grip 150 around the object. It should also be appreciated that in some embodiments, a switch or actuator may be included on the walking cane 100 such that the operation of the jaw-grip can be switched between the first embodiment and the second embodiment depending on user preference.

It should also be appreciated that in either embodiment or configuration, once the jaw-grip is secured around an item, the lock 136 can be utilized to secure the jaw-grip 150 into the current position.

FIG. 3 is an exploded view of the walking cane 100 illustrated in FIG. 1 and presents further detail of the operation of the steady-state open embodiment of the jaw-grip 150. The jaw-grip 150 is shown as including a recessed grabber with teeth 154, a hook 166 and adjustable cord 156 attached to the shaft 133 of the trigger 132, a pin 152 with a torsion spring 168, trigger 132 and guide track 134. In operation of the illustrated exemplary embodiment, the trigger 132 can be squeezed by the user holding on to the handle 130 and extending his or her fingers to the trigger 132 and applying pressure to pull the trigger 132 towards the hand grip 130. The adjustable cord 156, which may be a nylon string, cotton string, chain, rod, linked rod, spring, elastic chord or the like, is attached at one end to the trigger 132 and at the other end to the hook 166 positioned on the recessed grabber with teeth 154. The recessed grabber pivotally rotates from an open to a closed position about the positive pin 152 and the torsion spring 168. As the trigger 132 is pulled, the trigger string 156 retracts thereby causing the jaw-grip 150 grabber to rotate around the positive pin 152 to a closed position. When the trigger 132 is released, the trigger string returns to position and the gripper 150 rotates around the positive pin 152 by a force applied by the torsion spring 168 to the open position. Thus, the torsion spring 168 operates to bias the recessed grabber 150 into the open position and by actuation of the trigger 132, the bias of the torsion spring 168 is overcome to force the jaw-grip 150 into the closed position—recessed into an aperture, slot or hole in the lower shaft 116 or, in some embodiments pressed against the lower shaft 116. The trigger string 156 is attached or associated with the jaw-grip 150 either directly or by means of hook 166 that is attached to the jaw-grip 150. If the lower shaft 116 and upper shaft 114 are telescoped to make the cane longer or shorter, the length of the trigger string 156 can be adjusted by pulling it taught over the hook 166 and retying the trigger string 156 at the new length. In other embodiments, the trigger string may include multiple loops or apertures through which the hook 166 can be placed for different adjustment lengths of the cane. The adjustment of the trigger string 156 can also be used to adjust the amount of swing of the jaw-grip 150 to adjust how much it opens. In addition, rather than adjusting the length of the trigger string 156, the hook 166 may be configured such that it can slide or be moved to different positions along the jaw-grip 150. Further, the trigger string 156 may be adjustable from the trigger 132 in some embodiments. For instance, the trigger string 156 may extend through an aperture in the upper shaft 114 and be secured to the trigger 132. The securing mechanism, such as a lock, clamp or simply a knot can be released and then the length of the trigger string adjusted.

Figure 4:
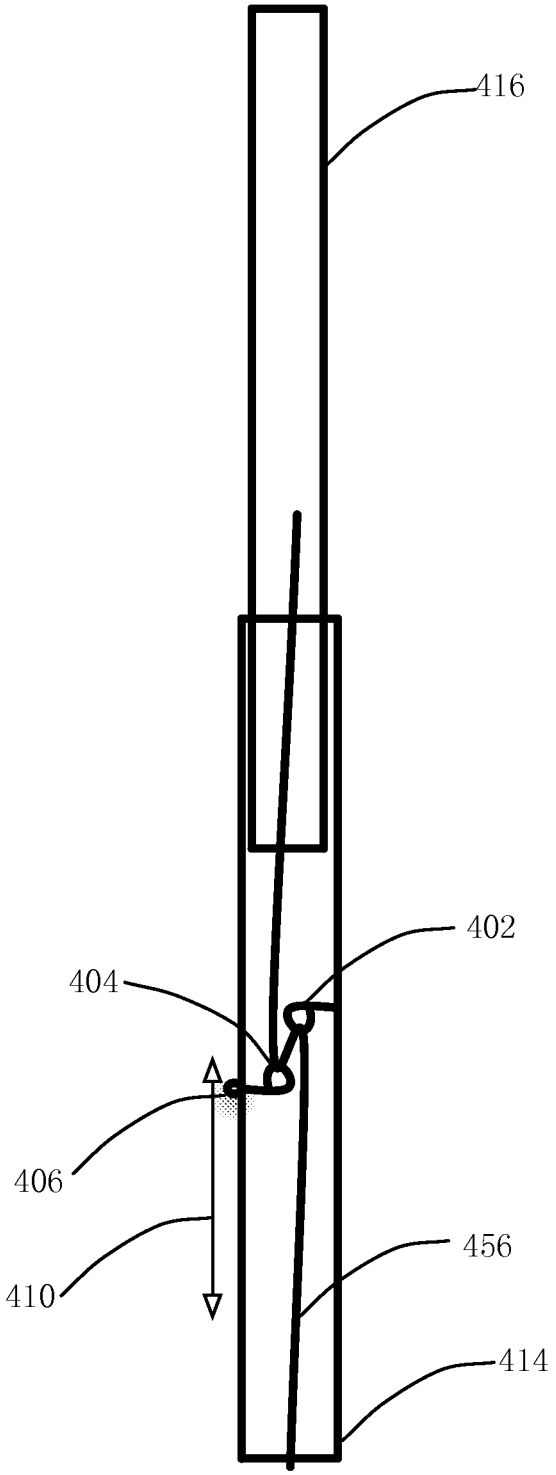
FIG. 4 is an exemplary embodiment of a trigger string adjustment mechanism that could be employed in various embodiments of a walking cane.

FIG. 4 is an exemplary embodiment of a trigger string adjustment mechanism that could be employed in various embodiments of a walking cane. In this illustrated embodiment, the trigger string 456 is shown as progressing through the interior of the upper shaft 414 and the lower shaft 416. The trigger string 456 is threaded through fixed loop 402 and adjustable loop 404. In this embodiment, the trigger string 456 can be tightened or the length adjusted to accommodate different cane lengths or simply to remove slack that may develop over time. The trigger string 456 is adjusted by the user moving the adjustment knob 406 up or down the upper shaft 414 in the direction of arrow 410. Thus, the overall length of the trigger string 456 can be increased or decreased by sliding the adjustment knob 410 down the shaft or up the shaft respectively.

In an alternative embodiment, when the user does not desire to use the jaw-grip, the user can pull the trigger all the way up into a void defined in the underside of the handle and secure it into a locked position with push-pin which locks the trigger into the handle for storage. Other mechanism may also be used such as protrusions and detents, or other techniques. The jaw-grip can be constructed of a variety of materials including rubber, plastic, wood, aluminum, anodized aluminum, metal, stainless steel, plastic, composite materials, fiberglass, as a few non-limiting examples.

In the various embodiments, when the jaw-grip is in a closed or stored position, it allows the tip at the end of the lower shaft to be open for contact with the walking surface. In other embodiments, the jaw-grip may include the tip or the tip may exist partially on the shaft and partially on the end of the jaw-grip. The jaw-grip is illustrated as including teeth to help facilitate grabbing of items. The inside surface of the jaw-grip and/or the side of the lower shaft interfacing with the jaw-grip may be coated with a material to help facilitate the grabbing and holding of items, such as rubber, or silicone materials and may or may not also include teeth. In addition, a sticky adhesive could also be applied to the edge of the shaft or the jaw-grip.

As previously mentioned, the operation of the jaw-grip can be reversed. For example, the torsion spring 168 may operate to bias the jaw-grip into a closed position. In such an embodiment, a lever or other mechanism 801 within the interior of the lower shaft 116 may be associated with the trigger string 156 such that when the trigger 132 is actuated, the lever forces the jaw-grip outward, overcoming the force of the torsion spring and causing the jaw-grip to open. Upon release of the trigger, the lever retracts thereby allowing the torsion spring 118 to pull the jaw-grip 150 back into the interior of the lower shaft 116. Those of ordinary skill in the art will be familiar with the mechanics involved to create this operation.

Also, as previously mentioned, the walking cane 100 may be configured such that the operation of the jaw-grip 150 can be changed from positive (biased open) to negative (bias closed). As a non-limiting example, this embodiment may be implemented by utilizing two trigger strings 156 and 157 and two torsion springs 168 and 169. One or more mechanical switches 153 can be utilized to switch between which torsion spring is active and which trigger string is actuated by the trigger 132.

In the previously described embodiments, the hinging element 126 was described as being attached to the interior of the upper shaft 114 and lower shaft 116. In another embodiment, the hinging element 126 may be attached to the trigger string 156 at one end that is located within the interior of lower shaft 116 and at the opposing end within the interior of upper shaft 14. In this embodiment, the hinging mechanism 126 further operates to remove slack in the trigger string 156. Further, this embodiment allows the jaw-grip 150 to open to a steady state position that is attached when the trigger is released and the trigger string and hinging mechanism is pulled tight by the torsion spring 168. However, there may be some slack in the trigger string 156 existing between the two connection points of the hinging mechanism. This configuration will allow the jaw-grip to be further opened by applying a force to the jaw-grip 150, either by hand or by forcing a larger object between the jaw-grip 150 and the surface of the lower shaft 116. In response to this force, the grabber can move or swing open further while the hinging mechanism is stretched to the point at which the slack in the trigger string 156 is removed.

As previously mentioned, an advantage of the multiple shaft embodiments is that the walking cane 100 can be broken down for storage. As a non-limiting example, one embodiment of the versatile walking can be broken down by disconnecting the trigger string 156 from the hook 166, or at least adjusting the trigger string 156 to be longer, and then depressing the spring loaded push-pin 118 and pulling the upper shaft 114 and lower shaft 116 in opposing directions. Alternatively, the trigger can be released allowing the grabber to move to the open position and then, the spring loaded push-pin 118 can be depressed and opposing pressure applied to the upper shaft 114 and lower shaft 116. As the shafts come apart, the jaw-grip 150 is pulled towards the lower shaft 116 as the trigger string 156 become tighter.

In some embodiments, a hook, or loop or other mechanism can be further used to secure the jaw-grip 150 against the lower shaft 116.

In yet other embodiment, the hinging mechanism can be removed entirely and the cane configured such that it cannot be broken down. In yet other embodiments, the trigger string 156 itself may operate as the hinging mechanism. This latter embodiment may be accomplished if the trigger string is elastic or non-elastic. In the elastic embodiments, the elasticity of the trigger string 156 must be selected to ensure proper operation of the jaw-grip 150. For instance, if the trigger string 156 has a high level of elasticity, insufficient force may be applied to the jaw-grip 150 to securely hold items. However, if the elasticity is too low, it may not allow enough stretching to allow for the upper shaft 114 and lower shaft 116 to be separated.

Figure 5:
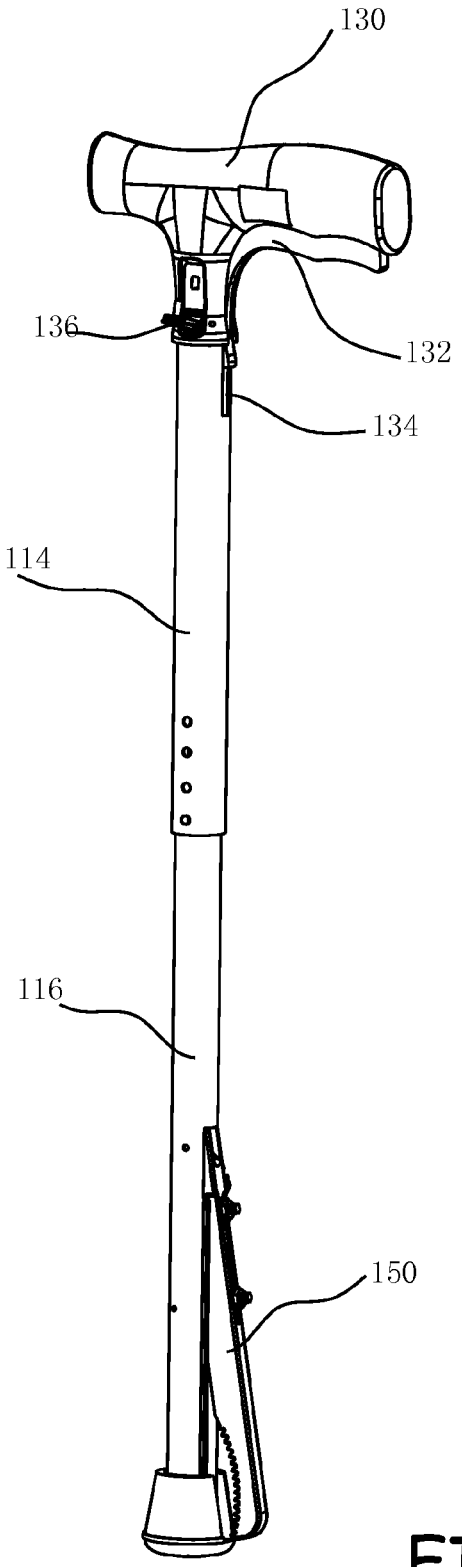
FIG. 5 is an illustration showing the walking cane 100 of FIG. 1 in a partially closed position.

FIG. 5 is an illustration showing the walking cane 100 of FIG. 1 in a partially closed position.

Figure 6:
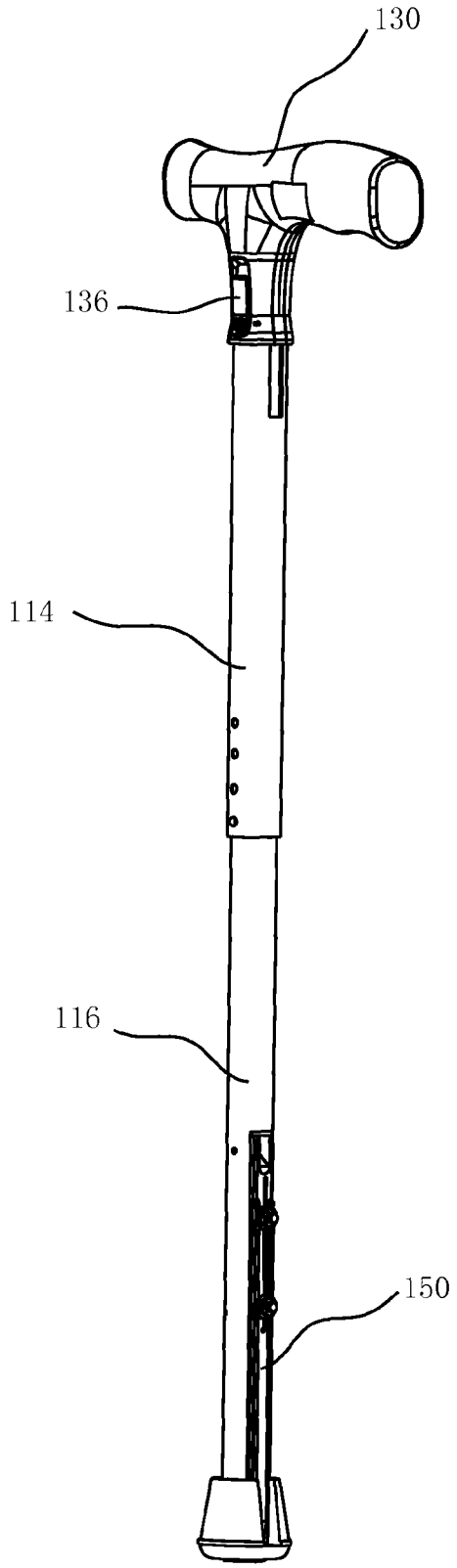
FIG. 6 is an illustration showing the walking cane 100 of FIG. 1 in a fully closed position.

FIG. 6 is an illustration showing the walking cane 100 of FIG. 1 in a fully closed position.

Figure 7:
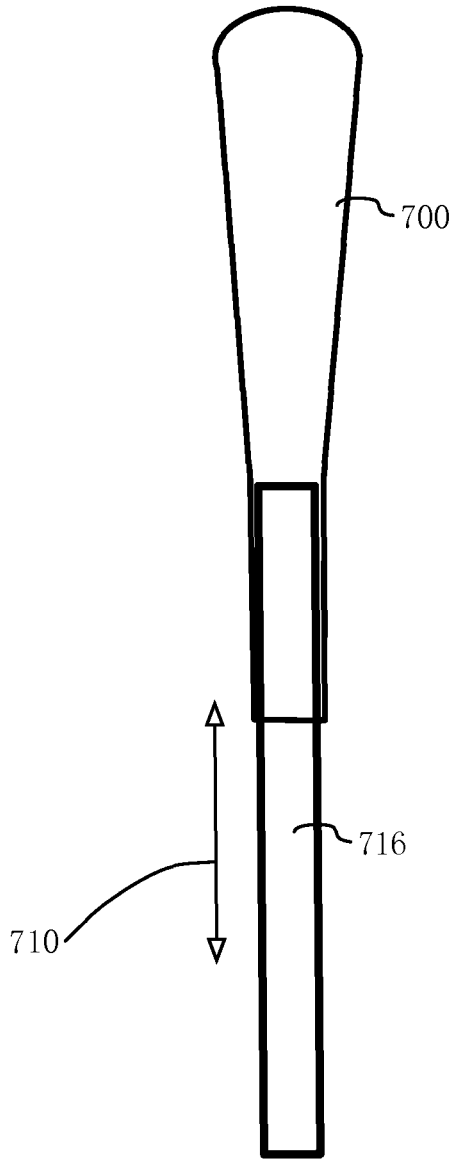
FIG. 7 is a side view diagram of an exemplary embodiment of a shoehorn tool that can be attached to an exemplary walking cane.

The walking cane 100 may also include other tools, such as a shoehorn as a non-limiting example. FIG. 7 is a side view diagram of an exemplary embodiment of a shoehorn tool that can be attached to an exemplary walking cane. The shoehorn 700 is illustrated as a snap-on or attachable tool. The shoehorn can be secured to the lower shaft 716 in a variety of manners and a snap-on attachment is only one non-limiting example. The shoehorn 700 may be configured to be slideably attached to the lower shaft 716 such that it can be retracted when not in use by sliding the shoehorn 700 in the direction of arrow 710. Further, the shoehorn 700 may be easily detached from the lower shaft 716 and then stored separately. In addition, the shoehorn 700 may snap or be attachable to the lower shaft 716 when it is desired to be used, then removed and attached to another portion of the shaft when not in use. In addition, a bag may be attached to the shaft to allow the shoehorn and/or other attachments to be stored when not in use. In the slidably attached embodiment, the shoehorn 700 can be attached to the lower shaft 116 and slid into an operational position. Detents or spring loaded push-pins or other mechanisms can be used to secure the shoehorn 700 into an operational position. When the shoehorn 700 is no longer necessary, the shoehorn 700 can be slid up the lower shaft 116 such that the end of the shoehorn 700 is above the end of the lower shaft 716 and thus, does not obstruct the use of the walking cane. The shoehorn 700 can be constructed of a variety of materials including rubber, plastic, wood, aluminum, anodized aluminum, metal, stainless steel, plastic, composite materials, fiberglass, as a few non-limiting examples.

In some embodiments, rather than an "alligator" style gripper, a loop mechanism can be employed. In such an embodiment, one end of a flexible strap, such as a nylon, leather, silicone, rubber, etc., strap is affixed to the end of the lower shaft proximate to the end of the lower shaft 114. In such embodiments, when the trigger 132 is released, the opposing end of the loop is drawn towards the tip thereby creating a loop that consists of the strap and the side of the lower shaft. The loop can be slid over items and then the trigger can be pulled to tighten the loop around the object.

In other embodiments, rather than a single jaw-grip, multiple jaw-grips can be attached to the lower shaft to further facilitate picking up items.

In some embodiments, rather then a trigger 132 as illustrated, a simple hook or pistol like trigger may be used.

It will be appreciated that other attachments may also be incorporated into the versatile walking cane. For instance, a battery powered light 802 may be included such that the cane can be utilized as a flash light or, as a warning light to alert others to your presence. Further, in some embodiments the light 802 may be configured such that when it is on, it illuminates and area around the tip end of the lower shaft 114 or in front of the tip end of the lower shaft 114 to facilitate the user being able to see the surface where the walking cane is being placed. Another light 803 may be used to illuminate the jaw-grip area to aid a user in grabbing items.

Another attachment may include a tool, such as a screwdriver that can be attached to the end of the cane and retracted when not in use. Further, the interior of the cane may include a mechanism that can be turned on or off to provide power to the screwdriver. A magnet may also be included in the lower end of the cane or the jaw-grip to facilitate picking up and holding items. It is anticipated that other attachments may also be included in various embodiments.

Figures 8A, 8B, 8C:
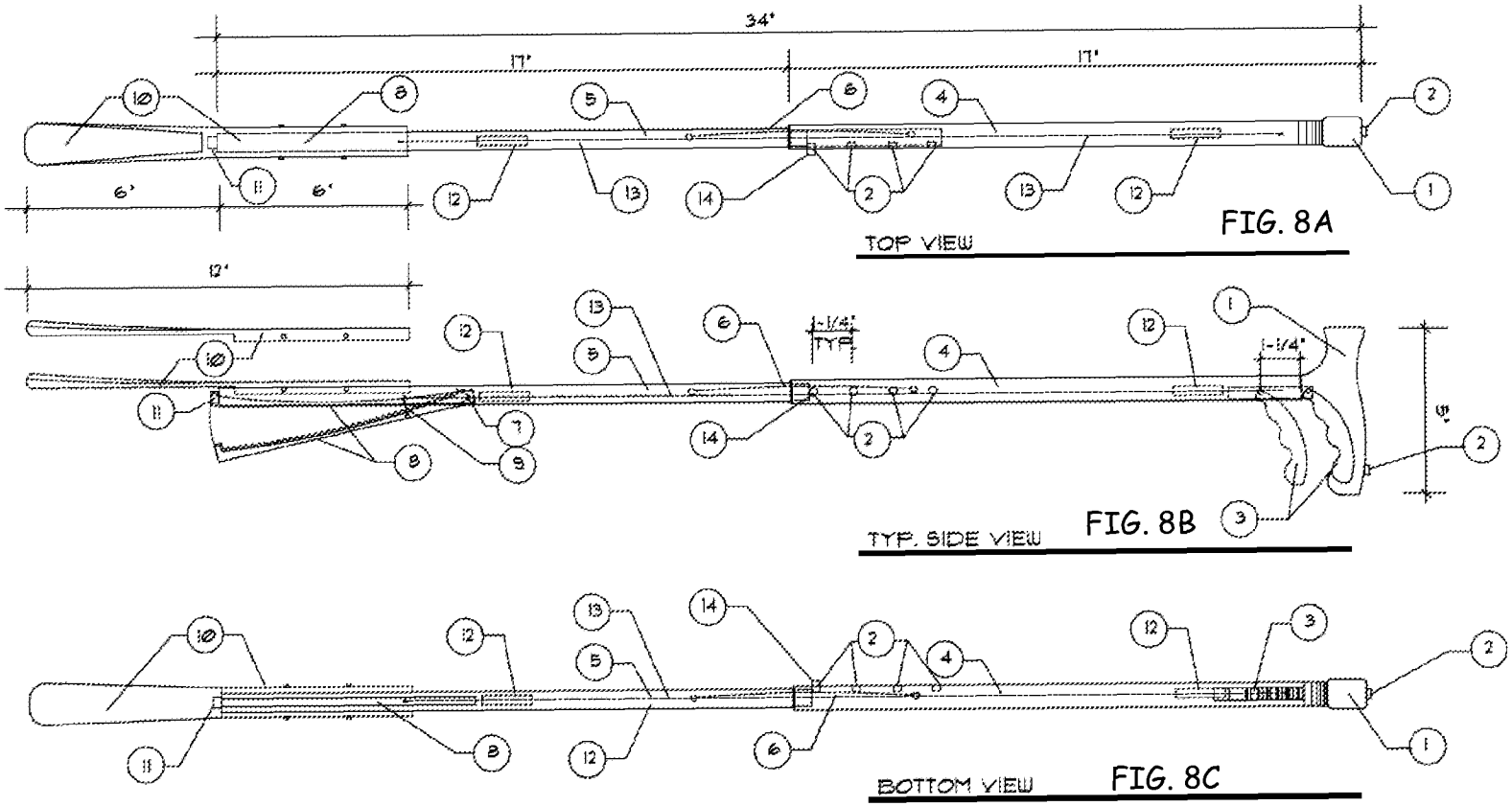

FIGS. 8A-8D show an alternative embodiment of a walking cane. In the illustrated embodiment, FIG. 8A presents a top or front view, FIG. 8B illustrates a side view and FIG. 8C illustrates a bottom or back view. FIG. 8D provides a parts list for the illustrated embodiment. Exemplary measurements that can be used in the construction of such exemplary embodiment are also presented; however, these measurements should not be construed as limiting elements to the disclosed invention although the particular dimensions may be considered as novel. The illustrated embodiment includes a two-piece shaft but it should be appreciated that a single piece shaft or a shaft with more than two pieces can be utilized in other embodiments. In the multi-piece shaft embodiments, it should also be appreciated that the shaft elements can be retracted in a telescoping manner to decrease the size of the versatile walking can for storage purposes. The parts list for the particular embodiment illustrated in FIGS. 8A-8C is provided in FIG. 8D and describes the aluminum hand grip 1, 3/16" diameter push pin holes 2, aluminum trigger with 3" L. Extension 3, 1" diameter 18 gauge anodized aluminum shaft w 1" tapered tip 5, 3/8" by 8" L. rubber band 6, positive pin w/ a torsion spring w/ 1/4" body and 1" legs 7, recessed adjustable aluminum grabber with teeth 8" in length 8, hood and adjustable chord 9, aluminum snap-on shoehorn w/ sleeve attachment 10, 1/2" thick by 7/8" diameter notched soft rubber tip 11, 1/2" by 1/2" aluminum U-shaped guide track 12, nylon string trigger 13 and spring loaded 1/4 diamond head locating pin 14.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. A walking cane comprising:

an upper shaft and a lower shaft, the upper shaft and lower shaft configured to be slideably attached to create a cane shaft such that a length of the walking cane can be adjusted, and including a lock to fix the upper shaft and lower shaft into a position relative to each other;

a handle attached integrated into the end of the upper shaft that is distal from the lower shaft, the handle including a trigger that can be actuated by applying a force to pull the trigger towards the handle;

the lower shaft including a slot located in the side of the lower shaft and extending from the end of the lower shaft that is distal from the upper shaft for a particular length towards the upper shaft to define a slot upper end;

a jaw-grip that pivotally attaches within the slot at the slot upper end, the jaw-grip being coupled to the trigger in such a manner that when the trigger is in a first position, the jaw-grip moves to a first position rotating from the side of the lower shaft for receiving an item to be picked up and when the trigger is in a second position, the jaw-grip moves to a second position to secure the item to be picked up between the jaw-grip and the lower shaft and, in the absence of an item to be picked up, the jaw-grip is retracted within the slot, the jaw-grip extending substantially the entire length of the slot and retracting fully into the slot;

a tip positioned on the opposing end of the cane shaft from the handle, wherein the tip can be placed on a surface when the walking cane is used for supporting a walking user and, the jaw-grip does not obstruct the tip from engaging such surface and, the tip including a slot such that when aligned with the slot on the lower shaft, the jaw-grip can be retracted into the slot.

2. The walking cane of claim 1, wherein the upper shaft and lower shaft include an interior and, an interior diameter of the upper shaft is greater than an exterior diameter of the lower shaft such that the upper shaft can be slid over the lower shaft.

3. The walking cane of claim 2, wherein the jaw-grip is pivotally attached within the slot at the slot upper end of the lower shaft with a pin and, a torsion spring biases the jaw-grip into a particular position.

4. The walking cane of claim 3, wherein the torsion spring biases the jaw-grip into an open position and, a trigger string is attached at one end to the trigger and at the opposing end to the jaw-grip such that actuation of the trigger causes the string to pull the jaw-grip into a closed position.

5. The walking cane of claim 3, wherein the torsion spring biases the jaw-grip into a closed position and, a trigger string is attached at one end to the trigger and at the opposing end to a lever such that actuation of the trigger causes the lever to force the jaw-grip into an open position.

6. The walking cane of claim 3, wherein a first torsion spring biases the jaw-grip into an open position and, a first trigger string is attached at one end to the trigger and at the opposing end to the jaw-grip such that actuation of the trigger causes the string to pull the jaw-grip into a closed position and, wherein a second torsion spring biases the jaw-grip into a closed position and, a second trigger string is attached at one end to the trigger and at the opposing end to a lever such that actuation of the trigger causes the lever to force the jaw-grip into an open position, and further including a mechanical switch to activate only one of the first torsion spring and second torsion spring and one of the first trigger string and the second trigger string.

7. The walking cane of claim 3, further comprising a slideably attached shoehorn that can be extended to an operational state and retracted to a stored state.

8. The walking cane of claim 3, further comprising a light that illuminates an area in front of the walking cane.

9. The walking cane of claim 3, further comprising a light that illuminates the jaw-grip.

10. The walking cane of claim 3, further comprising an interface at the end of the cane shaft distal from the handle, wherein the interface can receive one of a variety of tools.

11. The walking cane of claim 10, wherein the variety of tools includes at least one of a shoehorn, a screwdriver, a magnet and a tip.

12. The walking cane of claim 3, further comprising a lock that can secure the jaw-grip into a closed position.

13. The walking cane of claim 3, wherein the torsion spring biases the jaw-grip into a closed position and, a trigger string is attached at one end to the trigger and at the opposing end to a lever such that actuation of the trigger causes the lever to force the jaw-grip into an open position and, an adjustment switch to increase or decrease the length of the trigger string to adjust the length of the pivot of the jaw-grip.

14. A walking cane comprising:

an upper shaft and a lower shaft, the upper shaft and lower shaft being hollow and the upper shaft having an interior diameter that is larger the an outer diameter of the lower shaft such that the upper shaft and lower shaft can be slideably attached to create a cane shaft such that a length of the walking cane can be adjusted, and including a lock to fix the upper shaft and lower shaft into a position relative to each other;

a handle attached to one end of the cane shaft, the handle including a trigger that can be actuated by applying a force to pull the trigger towards the handle;

the lower shaft defining a slot for receiving a jaw-grip, the slot extends from a tip of the lower shaft that is distal from the upper shaft and extends from the tip of the lower shaft for a particular length towards the upper shaft to define a slot upper end;

the jaw-grip being pivotally attached at one end within the interior of the lower shaft-proximate to the slot upper end, the jaw-grip being coupled to the trigger with a trigger string in such a manner that when the trigger is actuated, the string pulls the jaw-grip into an open position and the jaw-grip enters a retracted position wherein the jaw-grip is substantially completely retracted into the interior of the lower shaft through the slot when the trigger is released;

a torsion spring attached to the jaw-grip to bias the jaw-grip to move into the retracted position position;

a tip positioned on the opposing end of the cane shaft from the handle, wherein the tip can be placed on a surface when the walking cane is used for supporting a walking user and, the jaw-grip does not obstruct the tip from engaging such surface, the tip defining a tip slot that coincides with the slot defined by the lower shaft such that the jaw-grip can be moved into the retracted position.

15. The walking cane of claim 14, further comprising a light that illuminates an area in front of the walking cane.

16. The walking cane of claim 14, further comprising a light that illuminates the jaw-grip.

17. The walking cane of claim 14, further comprising a first light that illuminates an area in front of the walking cane and a second light that illuminates the jaw-grip.

18. The walking cane of claim 14, further comprising an interface at the end of the cane shaft distal from the handle, wherein the interface can receive one of a variety of tools.

* * * * *